US005654016A

United States Patent [19]

Shell

[11] Patent Number: 5,654,016

[45] Date of Patent: Aug. 5, 1997

[54] WAX ARTWORK KIT

[76] Inventor: Robert S. Shell, 5895 #3 Evergreen Rd., Dearborn Heights, Mich. 48127

[21] Appl. No.: 402,930

[22] Filed: Mar. 13, 1995

[51] Int. Cl.[6] ..... B05D 5/06

[52] U.S. Cl. ..... 425/87; 219/417; 425/458; 434/84

[58] Field of Search ..... 219/417, 428, 219/478, 480; 434/82, 84, 81; 206/229, 575; 425/87, 458, DIG. 57, 317

[56] References Cited

U.S. PATENT DOCUMENTS

| | | | |
|---|---|---|---|
| D. 185,614 | 6/1959 | Reading | D7/326 |
| D. 246,245 | 11/1977 | Gill et al. | D7/364 |
| 660,952 | 10/1900 | Hall | 425/458 |
| 1,362,809 | 12/1920 | McManus | 219/417 |
| 1,703,785 | 2/1929 | Shuttleworth | 425/458 |
| 2,166,616 | 7/1939 | Wallace | 206/1.7 |
| 2,379,504 | 7/1945 | Thompson | 219/417 |
| 2,730,608 | 1/1956 | Axelsson | 219/428 |
| 3,345,497 | 10/1967 | Porteous | 219/417 |
| 3,840,113 | 10/1974 | Bartleson | 206/575 |
| 4,279,674 | 7/1981 | Wadden | 434/84 |
| 4,489,235 | 12/1984 | Porteous | 219/417 |
| 4,584,042 | 4/1986 | Wandroik | 434/84 |
| 5,044,957 | 9/1991 | Kuranaga | 434/82 |

FOREIGN PATENT DOCUMENTS

| | | | |
|---|---|---|---|
| 1338017 | 8/1963 | France | 425/87 |
| 553068 | 5/1943 | United Kingdom | 206/229 |

*Primary Examiner*—Robert Davis

*Attorney, Agent, or Firm*—Weiner, Carrier & Burt, P.C.; William F. Esser; Irving M. Weiner

[57] ABSTRACT

A kit and method for making artwork in wax. The kit includes a plurality of thermally conductive containers; at least one substantially solid wax compound; a heating unit for heating each of the containers, having a separate temperature control for each container; an applicator for applying a heated wax compound to an article; and wherein each of the containers selectively slidably engages with the heating unit.

19 Claims, 1 Drawing Sheet

WAX ARTWORK KIT

BACKGROUND OF THE INVENTION

1. Field of Invention

This invention pertains to an apparatus and method for creating artwork in wax, and particularly for creating temporary wax artwork.

2. Description of the Relevant Art

There are known batik kits and heating devices. For example, Bartleson U.S. Pat. No. 3,840,113 discloses a batik kit for creating designs on fabric using wax and dyes. Bartleson, however, fails to disclose a kit or method of creating two and three dimensional temporary wax articles using a variety of wax applicator tools.

Gill et al. U.S. Des. Pat. No. 346,245 discloses the ornamental design of a commercial food cooking device. Gill, however, fails to disclose a heating unit having a plurality bins for heating articles separately, and wherein each bin is selectively removable and includes a section defined thereon for conveniently pouring a partially melted article.

Reading U.S. Pat. Des. No. 185,614 discloses a baby dish, but fails to disclose a heating unit having a plurality of removable bins for heating articles separately, and wherein each bin includes a means for conveniently pouring or discharging a partially melted article.

Wallace U.S. Pat. No. 2,166,616 discloses a paint box palette for maintaining and storing a plurality of liquids separately, but fails to disclose a device for separately heating a plurality of articles, including a plurality of detachably engageable bin members having means for discharging substantially melted materials therefrom.

SUMMARY OF THE INVENTION

The present invention overcomes the above-discussed limitations and shortcomings of known artwork creating devices and satisfies a significant need for such an apparatus which allows the user thereof to create both permanent and temporary two and three dimensional artwork utilizing wax material.

According to the invention, there is provided an apparatus for use in creating artwork in wax, comprising a heating unit having a plurality of bins defined therein, means for individually controlling the temperature of each bin, means for selectively detaching each bin from the heating unit, and wherein each bin includes a spout for pouring semi-liquid compositions; at least one trowel member having means for removing a semi-melted composition from a bin of the heating unit and means for applying a semi-melted composition to an article so as to achieve any of a wide variety of shapes and surfaces; a plurality of brushes of various sizes and shapes, for applying a substantially liquid wax compound to an object; and an applicator for dispensing a partially solidified composition in any of a plurality of shapes.

The method of creating the artwork comprises the steps of obtaining the heating unit and placing the detachable bins therein; placing the desired solid wax compounds in the appropriate bins, each bin having a wax compound of a different color; independently heating the desired bins using the temperature control means of the heating unit, until the desired consistency of each wax compound is reached; selectively removing portions of the semi-melted wax compounds from the heating bins and applying the wax portions to an object using a trowel, brush, or other applicators. After the wax compounds have hardened, the wax may be selectively removed from the object using a trowel or similar article, and placed in the appropriate bins for reuse through reheating the wax therein. When not in use, the wax compounds are optionally stored in the bins.

The method and corresponding apparatus is useful in easily creating artwork by applying the wax compounds to screen, glass or canvas. Alternatively, three dimensional artwork may be created formed substantially of wax.

It is an object of the invention to provide an apparatus and method for creating artwork in wax, for use by both children and adults.

It is another object of the invention to provide a method for creating temporary artwork so that the wax may be reused to create other wax artwork.

Another object of the invention is to provide a kit for creating such artwork in wax.

Other objects, advantages and salient features of the present invention will become apparent from the following detailed description, which, when taken in conjunction with the annexed drawings, discloses preferred embodiments of the present invention.

DETAILED DESCRIPTION OF THE PREFERRED EMBODIMENTS

Referring to FIGS. 1–5, there is shown an apparatus for creating artwork in wax, including heating unit 1, trowel members 2–3, brushes 4, wax applicator 5–6, and removable bins 7.

Figure 1:
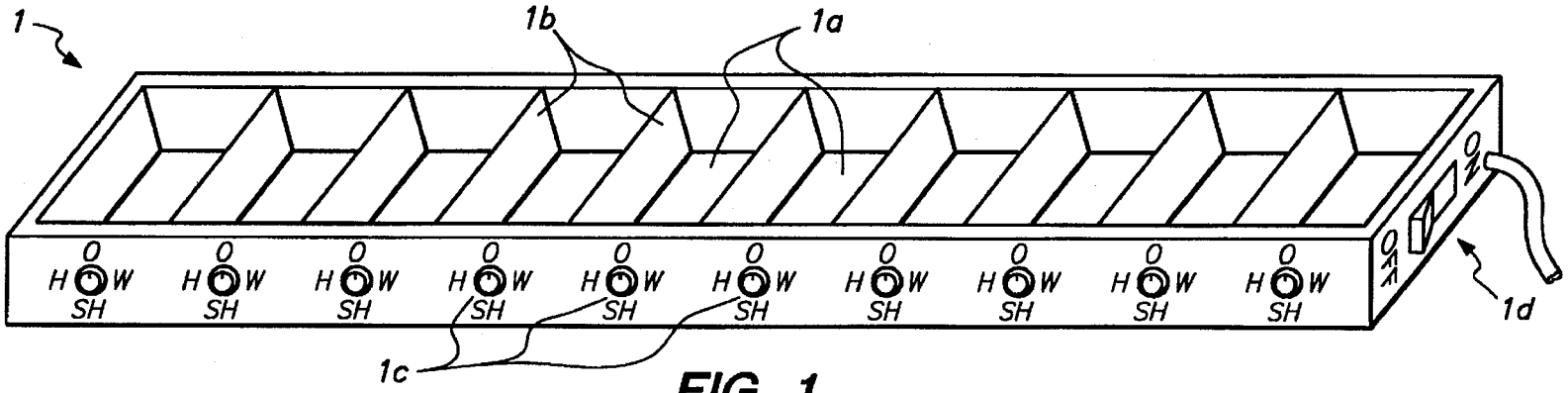
FIG. 1 is a perspective view of the heating unit of the preferred embodiments of the present invention.

Heating unit 1 is adapted to transfer heat to a wax compound, heating unit 1 having a recess defined therein and a plurality of partitions **1*b* defined laterally across the recess so as to form a plurality of recesses 1*a*, as shown in FIG. 1. The side and bottom surfaces of recesses 1*a*, and partitions 1*b*** are preferably constructed from a substantially thermally conductive material so as to effectively transfer heat to articles placed therein.

Heating unit 1 additionally includes a means for independently controlling the temperature of each recess **1*a*. Referring to FIG. 1, such independent heat controlling means comprises temperature control dials 1*c*, one control dial 1*c* corresponding to a separate recess 1*a*. Each control dial 1*c* is preferably but not necessarily disposed adjacent its corresponding recess 1*a*. Markings are preferably but not necessarily printed or otherwise disposed around each dial 1*c* so as to indicate to the user the selected temperature setting. Whereas each dial 1*c* controls the heat transferred to its corresponding recess 1*c*, master switch 1*d* universally switches temperature controls to recesses 1*c*** between an active (ON) state and an inactive (OFF) state.

Heating unit 1 is preferably but not necessarily electrically heated, using heating coils or other heat generating and transferring mechanisms. In the preferred embodiments of the invention, the outer surface of heating unit 1 is thermally is listed from recesses 1*a* so that heating unit 1 may rest on any surface or be handled by the user without causing any adverse effects.

The preferred embodiments of the present invention preferably but not necessarily include a plurality of bin members 7 (FIG. 5), which are each sized and shaped so as to fit substantially securely within a recess 1*c* of heating unit 1 so as to substantially prevent tipping. Bin members 7 are preferably constructed from a relatively thin, thermally conductive material, such as tin foil, so as to quickly transfer heat from a recess 1*a* to the article to be heated in bin 7.

Figure 5:
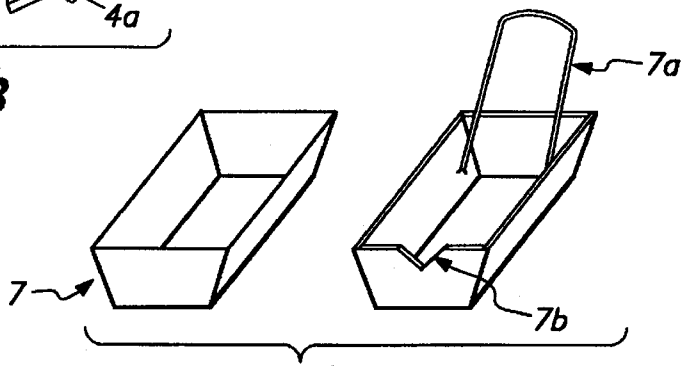
FIG. 5 is a perspective view of bin members of the preferred embodiments of the present invention.

Bin members 7 preferably but not necessarily include a means for pouring a semi-melted composition. As shown in FIG. 5, the pouring means comprises handle 7*a* and pouring spout 7*b*. Handle 7*a* preferably but not necessarily extends upwardly from an inner surface of the longitudinal sides of bin 7 so as that bin 7 maintains secure engagement with a recess 1*a* of heating unit 1 when placed therein. Handle 7*a* is preferably but not necessarily integrally formed with bin 7 as a unitary member, but alternatively handle 7*a* is selectively removable therefrom so that only one handle 7*a* is needed to pour a composition from each bin 7.

As shown in FIG. 5, a lateral side of bin 7 curves outwardly so as to form spout 7*b*. In this way, bin 7 may be manipulated by the use of handle 7*a* and spout 7*b* so as to effectively pour its contents therefrom.

Figure 2:
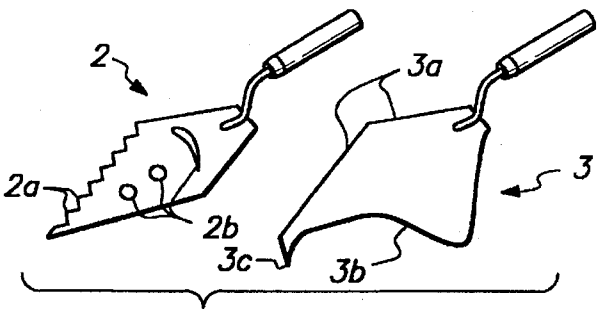
FIG. 2 is a perspective view of trowel members of the preferred embodiments of the present invention.
Figure 3:
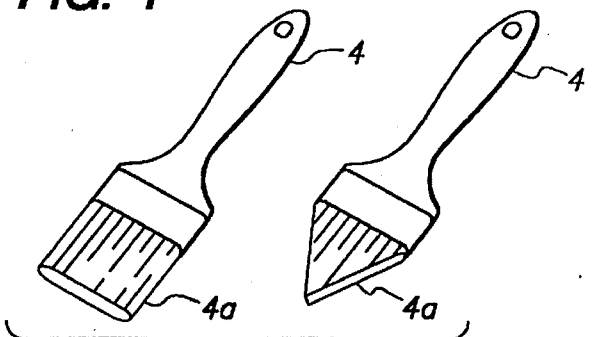
FIG. 3 is a perspective view of brush members of the preferred embodiments of the present invention.

The preferred embodiments of the present invention includes a means for applying a heated wax composition to an object. Referring to FIG. 2, one such applying means preferably but not necessarily includes a plurality of trowel members 2, 3, but alternatively only one trowel member may be used.

Because heated wax compounds remain in a substantially amorphous state for only a limited period of time, each trowel member 2 and 3 preferably includes means for efficiently facilitating and enhancing the creation of the artwork within the above-mentioned time period. Such means preferably comprises trowel members 2 and 3 having a plurality of differently shaped edges, such as a substantially saw-toothed edge 2*a* or curved edges 3*b*. Further, trowel members 2 and 3 preferably but not necessarily include one or more apertures 2*b*. Trowel member 3 preferably includes straight edges 3*a* and 3*c*, which, when associated with each other and with curved edge 3*b*, form obtuse and acute angles (FIG. 2). Such trowel features allow the user to relatively quickly mold or otherwise form the heated wax so as to quickly create the desired artistic effect before the wax compound substantially solidifies. These trowel features thus allow the user to create a wider range of artistic creations which she would not otherwise be able to create.

The present invention may additionally use one or more brushes 4 together with trowel members 2 and 3 so as to provide the user with further means for applying or otherwise forming the heated wax so as to substantially quickly achieve the desired effect. Brushes 4 preferably but not necessarily include a variety of widths and/or thicknesses, such as brush 4 bristles forming a pointed end 4*a*, and are used to apply a melted or semi-melted wax compound to an article.

Figure 4:
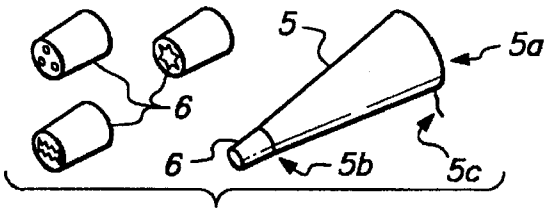
FIG. 4 is a perspective view of a third applicator of the preferred embodiments of the present invention.

The preferred embodiments of the present invention preferably but not necessarily include an applicator for dispensing a semi-liquid composition having a decorative shape. Referring to FIG. 4, the applicator comprises flexible bag portion 5, having an opening at a first end 5*a* for receiving the semi-liquid composition and a second end 5*b* for dispensing the composition. First end 5*a* includes a substantially widened opening which is selectively closed by drawstring 5*c* in order to substantially prevent spillage. Second end 5*b* preferably but not necessarily includes a means for selectively attaching any of a variety of tip members 6. Each tip member 6 preferably includes an aperture defined therethrough having a different shape (FIG. 4). In this way, the composition forms a unique shape as it is dispensed from bag portion 5 through the attached cap member 6 by hand-applied pressure.

The preferred embodiments of the present invention preferably but not necessarily allow the user to create two or three dimensional artwork or decorations in wax. Two dimensional artwork is preferably but not necessarily created by heating the wax compound until it is substantially melted and applying the melted compound to a two dimensional surface using brushes 4. The two dimensional surface preferably but not necessarily comprises canvas, but in an alternative embodiment the surface comprises a substantially smooth surface such as glass, wax paper, aluminum foil, fiberglass or other resin compound.

Three dimensional artwork is preferably but not necessarily created by forming, molding or otherwise working a substantially softened wax compound into the desired shape using trowels 2, 3, and/or applicator 5, 6. Alternatively, the three dimensional artwork may be created by forming, molding or otherwise applying the heated wax over a preexisting object.

The preferred embodiments of the present invention preferably but not necessarily allow a user to create artwork temporarily in wax, thereby providing an activity in which children and adults can enjoy for hours at a time. After the wax artwork has sufficiently cooled, the wax compounds may be removed from the object to which the wax compounds were applied using trowels 2 or 3, and thereafter returned to bins 7. The removal of the wax compounds from the object is best performed by first heating trowel 2 or 3 and subsequently scraping, cutting or peeling the wax compound therefrom. In the event the artwork was created using wax compounds of different colors, the wax compounds are first sorted by color prior to returning them to the appropriate bins 7.

In use, the solid wax compounds are first placed in bins 7, and bins 7 are placed within recesses 1*a* of heating unit 1. If wax compounds of different colors are used to create multicolored artwork, the wax compounds for each color are placed in a separate bin 7. Thereafter, bins 7 are heated to the desired temperature by activating temperature controls 1*c* corresponding to bins 7 having the wax compounds therein. The selected temperature setting of temperature controls 1*c* depends in part upon the desired consistency of the heated wax compounds.

After the wax compounds have been sufficiently heated to the desired temperature, the heated wax compounds are removed from the bins 7 and formed or worked so as to create the desired artistic or decorative article. Trowels 2 and 3 are preferably but not necessarily used to work a substantially softened wax compound by scooping the softened wax compound onto the desired trowel and forming it into the desired shape and texture utilizing trowel edges 2*a*–2*b* and 3*a*–3*c*.

Brushes 4 are preferably but not necessarily used to apply a substantially melted wax compound to an article by brushing a layer of substantially melted wax thereon.

Bins 7 having handle 7*a* and spout 7*b* are preferably but not necessarily used to apply a heated wax compound to an article by pouring the wax compound from bin 7 onto the article.

Applicator 5 is preferably but not necessarily used to apply a semi-melted wax compound having a predetermined shape to an article. The wax compound is applied by first pouring the compound from bins 7 into bag-like member 5 via opening 5*a*. Thereafter, opening 5*a* is closed using drawstrings 5*c*. One of tips 6 is attached to dispensing end 5*b* of member 5, the selected tip member 6 having an aperture giving the desired shape of the softened wax compound as it is dispensed therethrough. The wax compound is then applied to an article by positioning tip member 6 relative to the article and selectively exerting hand pressure to bag member 5 until the wax compound is dispensed therefrom in the desired amount. Wax compounds of a different color may then be applied using the same aforementioned steps after bag member 5 and tip 6 have been cleaned or replaced.

Once the artwork has been created, the wax compounds are allowed to cool until it is substantially solidified throughout. Thereafter, the artwork may be optionally broken down so that the wax compounds may be used again. This step preferably but not necessarily comprises substantially breaking pieces of the wax compounds from the artwork and separating the pieces by color. Trowels 2 or 3 are preferably but not necessarily used to scrap or cut pieces of the wax compound from the finished artwork. Wax compound pieces are found to be more easily removed from the artwork if the working end of trowel 2 or 3 is first heated, for example by heating it with heating unit 1. Alternatively, wax compound pieces are separated from the finished artwork by another utensil or by hand.

Next, the pieces of wax compounds are returned to the appropriately bins 7. Bins 7 may be then reheated so that the wax compound pieces are melted combined with the unused wax compounds. Thereafter, the aforementioned process may be repeated so as to create another artwork in wax. Otherwise, the wax is preferably but not necessarily stored in bins 7.

The above-described apparatus and process may be used to decorate preexisting objects with wax, or to create artwork substantially entirely in wax. With regards to the latter type of creation, trowels 2, 3, pourable bins 7 and applicator 5, 6 are preferably but not necessarily used to form a three dimensional article, and thereafter trowels 2, 3 and brushes 4 are preferably but not necessarily used to add finishing touches to the surface of the article.

Although there have been described what is at present to be the preferred embodiments of the invention, it will be understood that the invention can be embodied in other specific forms without departing from the spirit or essential characteristics thereof.

The described embodiments are, therefore, to be considered in all aspects as illustrative, and not restrictive. The scope of the invention is indicated by the appended claims, rather than by the foregoing description.

I claim:

1. A kit for creating artwork, comprising:

a plurality of containers;

at least one substantially solidified wax compound;

means for heating said wax compound in said container, having controls for selectively setting a temperature thereof;

an object for receiving said heated wax compound along an outer surface thereof;

an applicator for applying said heated wax compound to said object, and for removing said wax compound therefrom when cooled;

said applicator includes at least one trowel member having a plurality of edges defined thereon for substantially removing said heated wax compound from said containers, applying said heated wax compound to said object, and sculpting said heated wax compound thereon;

said at least one trowel member includes edges which form acute and obtuse angles with each other; and each of said containers substantially slidably engages with said heating means when heating said wax compounds in said containers.

2. A kit as recited in claim 1, wherein:

said applicator includes a bag member having a first opening for receiving said heated wax compound therein and a second opening for discharging said heated wax compound from said bag member upon hand applied pressure, and at least one cap member having means for selectively engaging with said second opening of said bag member and an aperture defined through said cap member for discharging said heated wax compound having a desired shape.

3. A kit as recited in claim 1, wherein:

said object is comprised of screen material.

4. A kit as recited in claim 1, wherein:

each of said containers includes a handle member and a spout member for selectively pouring said heated wax compounds onto said object.

5. A kit as recited in claim 4, wherein:

said object is glass.

6. A kit as recited in claim 1, wherein:

said object comprises canvas material and means for maintaining said canvas material so as to form a two dimensional surface.

7. A kit for creating artwork, comprising:

at least one container, said container being substantially thermally conductive;

means for heating said at least one container;

at least one substantially solidified meltable compound;

applicator means for applying portions of said meltable compound in substantially melted form;

said at least one container substantially slidably engages with said heating means when heating said meltable compound in said containers; and said applicator means includes a bag member having a first opening for receiving said heated meltable compound therein and a second opening for discharging said heated meltable compound from said bag member upon hand applied pressure, and at least one cap member having a means for selectively engaging with said second opening of said bag member and an aperture defined through said cap member for shaping said heated meltable compound while discharging from said bag member.

8. A kit as recited in claim 7, wherein:

said applicator means includes at least one trowel member having a plurality of edges defined thereon; and adjacent edges of said at least one trowel member form acute and obtuse angles.

9. A kit as recited in claim 7, further including:

an object on which said heated meltable compound is applied.

10. A kit as recited in claim 9, wherein:

said object is glass.

11. A kit as recited in claim 9, wherein:

said object is comprised of screen material.

12. A kit as recited in claim 9, wherein:

a major portion of said object is two dimensional.

13. A kit as recited in claim 7, wherein:

said kit includes a plurality of cap members, with each of said cap members having an aperture defined therethrough which is shaped differently from apertures of other of said cap members.

14. A kit as recited in claim 7, wherein:

said at least one container includes a handle member and a spout member.

15. A kit as recited in claim 7, wherein:

said kit member includes a plurality of containers; and said heating means includes a means for heating said containers concurrently.

16. A kit as recited in claim 2, further including:

a plurality of said cap members, with each of said cap members including an aperture defined therethrough which is shaped differently from said apertures of other cap members.

17. A kit as recited in claim 1, wherein:

said kit includes a plurality of trowel members; and at least one of said trowel members includes a working edge which is substantially saw-toothed.

18. A kit as recited in claim 1, wherein:

said at least one trowel member includes a substantially curved edge for working said object.

19. A kit as recited in claim 8, wherein:

said at least one trowel member includes a curved edge.

* * * * *